US012357101B1

(12) United States Patent
Yang

(10) Patent No.: US 12,357,101 B1
(45) Date of Patent: Jul. 15, 2025

(54) INFLATABLE MATTRESS STRUCTURE WITH DETACHABLE AIR COLUMN

(71) Applicant: Formosa Saint Jose Corporation, Taipei (TW)

(72) Inventor: Ming-Shun Yang, Taipei (TW)

(73) Assignee: Formosa Saint Jose Corporation, Taipei (TW)

( * ) Notice: Subject to any disclaimer, the term of this patent is extended or adjusted under 35 U.S.C. 154(b) by 0 days.

(21) Appl. No.: 19/008,213

(22) Filed: Jan. 2, 2025

(30) Foreign Application Priority Data

Nov. 22, 2024 (TW) ..... 113145184

(51) Int. Cl.
*A47C 27/08* (2006.01)
*A47C 27/00* (2006.01)

(52) U.S. Cl.
CPC ..... *A47C 27/087* (2013.01); *A47C 27/081* (2013.01); *A47C 27/08* (2013.01)

(58) Field of Classification Search
CPC ... A47C 27/087; A47C 27/082; A47C 27/081; A47C 27/08
USPC ..... 5/711, 712, 709, 706, 644, 654, 655.3
See application file for complete search history.

(56) References Cited

U.S. PATENT DOCUMENTS

| | | | | |
|---|---|---|---|---|
| 633,968 | A * | 9/1899 | Swartzwelder ..... | A47C 27/081 5/655.3 |
| 1,361,453 | A * | 12/1920 | Frey ..... | A47C 27/081 267/117 |
| 3,899,797 | A * | 8/1975 | Gunst ..... | E04H 15/20 297/452.41 |
| 7,530,128 | B2 | 5/2009 | Wu | |
| 9,566,202 | B2 | 2/2017 | Chiang et al. | |
| 11,564,505 | B2 | 1/2023 | Liu et al. | |
| 2017/0273472 | A1 | 9/2017 | Liu | |

FOREIGN PATENT DOCUMENTS

| | | | | |
|---|---|---|---|---|
| DE | 19514945 | A1 * | 10/1996 | ..... A47C 27/081 |

* cited by examiner

*Primary Examiner* — Robert G Santos
(74) *Attorney, Agent, or Firm* — Ying-Ting Chen

(57) ABSTRACT

An inflatable mattress structure includes a cover including a first top cover portion, a second bottom cover portion arranged opposite to the first top portion and integrally extended from the first top cover portion to form an inner space; at least one main divider comprising a first divider end coupled with the first top cover portion and a second divider end coupled with the second bottom cover portion to divide the inner space into at least two sub-inner spaces; an air column detachably arranged inside the inner space and passed through each of the sub-inner spaces one by one; and an air valve coupled with a free end of the air column.

12 Claims, 15 Drawing Sheets

INFLATABLE MATTRESS STRUCTURE WITH DETACHABLE AIR COLUMN

FIELD OF THE DISCLOSURE

The present disclosure relates to an inflatable mattress structure, and more particularly to the inflatable mattress structure having air columns detachably arranged inside a cover of the inflatable mattress structure so that the air column can be easy to clean, replace, and maintain.

BACKGROUND OF THE DISCLOSURE

Generally, the inflatable mattresses are suitable for a variety of occasions. There are many types of inflatable mattresses, but they are generally used with a tougher single or multi-layer cover for direct inflation. Therefore, the cover must be repaired or replaced immediately once it is accidentally damaged.

In addition, traditional inflatable mattresses are not only easy to generate leaks but also cannot be quickly replaced, which greatly impacts users. Moreover, during actual use, it will produce a considerable degree of shaking, which causes discomfort for the user, or even more tipping, falling, or spilling on the human body or objects due to the shaking of the body of the inflatable mattress.

There may exist a desire to develop an improved inflatable mattress that can be easily set up, maintained, and stored after deflating.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily prevent them.

BRIEF SUMMARY OF THE DISCLOSURE

In a general implementation, the inflatable mattress structure may comprise a cover made of flexible material and comprising a first top cover portion, a second bottom cover portion arranged opposite to the first top portion and integrally extended from the first top cover portion and the second bottom cover portion to form an inner space inside the cover; at least one main divider comprising a first divider end tightly coupled with the first top cover portion and a second divider end tightly coupled with the second bottom cover portion to divide the inner space into at least two sub-inner spaces; and an air column detachably arranged inside the inner space and passed through each of the sub-inner spaces one by one; and an air valve tightly coupled with a free end of the air column; wherein one of the at least two sub-inner spaces is adjacent to another one of the at least two sub-inner spaces and communicates with the another one of the at least two sub-inner spaces.

In another aspect combinable with the general implementation, the inflatable mattress structure may further comprise at least one minor divider arranged inside the inner space and at least two minor inner spaces formed by the minor dividers, wherein each of the minor inner spaces does not communicate with each other, wherein each of the minor dividers comprises a first minor divider end coupled with the first top cover portion, a second minor divider end coupled with the second bottom cover portion, a third minor divider end coupled with the front-middle cover portion, a fourth minor divider end coupled with the rear-middle cover portion, wherein each of the main dividers is independent of each other, wherein each of the main dividers does not contact each other.

Further, it is contemplated that each of the main dividers is independent of each other, wherein each of the main dividers does not contact each other.

In the alternative, the main divider is a zigzag shape, wherein the main divider is arranged between the first top cover portion and the second bottom cover portion, wherein the main divider comprises at least one first divider end coupled with the first top cover portion and at least two second divider ends coupled with the second bottom cover portion, wherein each of the sub-inner spaces is a triangular shape.

It is still further contemplated that the air column comprises a free end fixedly coupled with the cover and the air valve.

In another aspect combinable with the general implementation, the air column comprises an elongated protrusion arranged on an inner surface of the air column and an outer surface arranged on an opposite side of the inner surface and exposed to the outside, wherein the elongated protrusion may be integrally and inwardly extended from the inner surface.

In another aspect combinable with the general implementation, the air column comprises an elongated supported member arranged inside the air column, wherein the elongated supported member is a three-dimensional strip-shaped member that is integrally extended from a free end of the air column to a distal end of the air column.

In another aspect combinable with the general implementation, the cover further comprises a zipper arranged on the middle cover portion, wherein the zipper bisects the middle cover portion.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, the operations, methods, or processes described herein may include more or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be of a precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably. It shall be understood that the term "means," as used herein, shall be given its broadest possible interpretation in accordance with 35 U.S.C., Section 112 (f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1A:
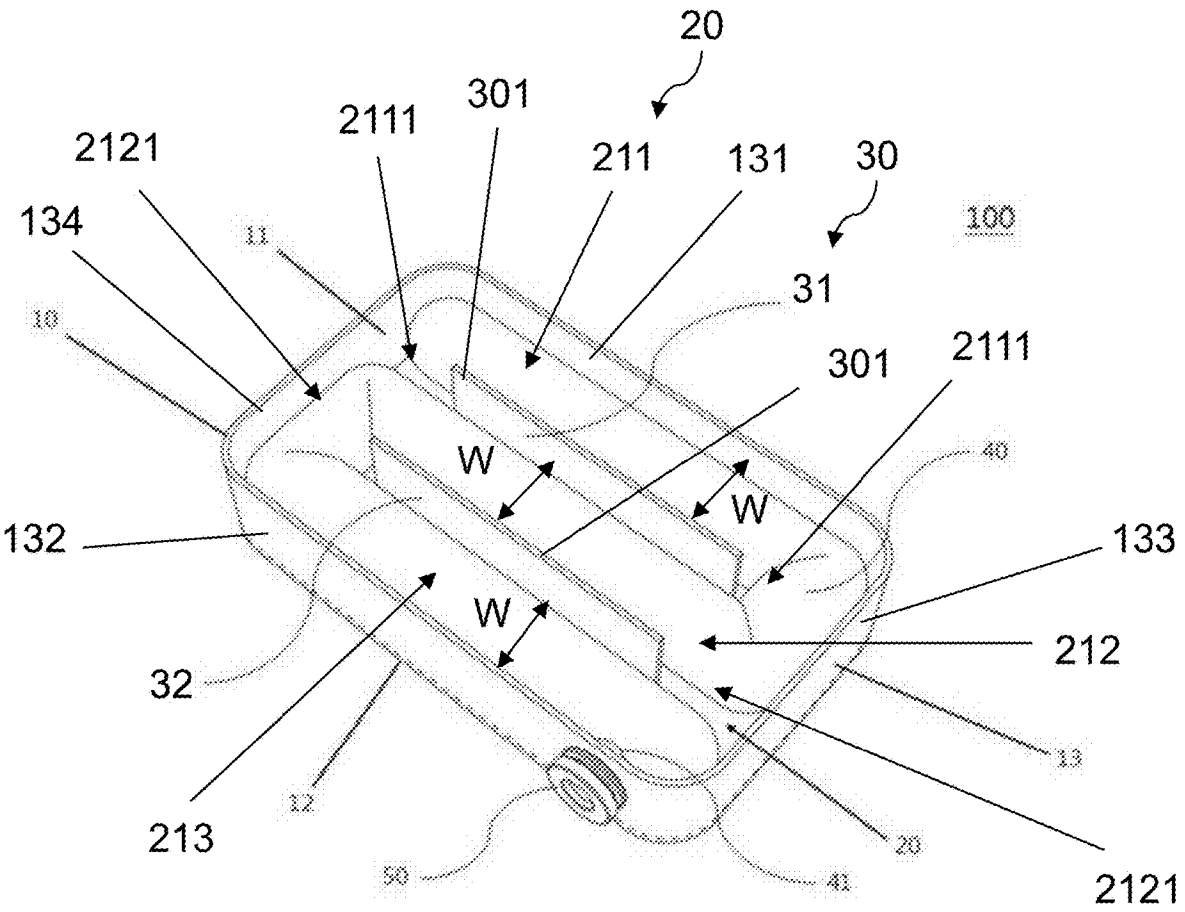
FIG. 1A is a perspective view of an inflatable mattress structure with a detachable air column according to an aspect of the embodiment.
Figure 1B:
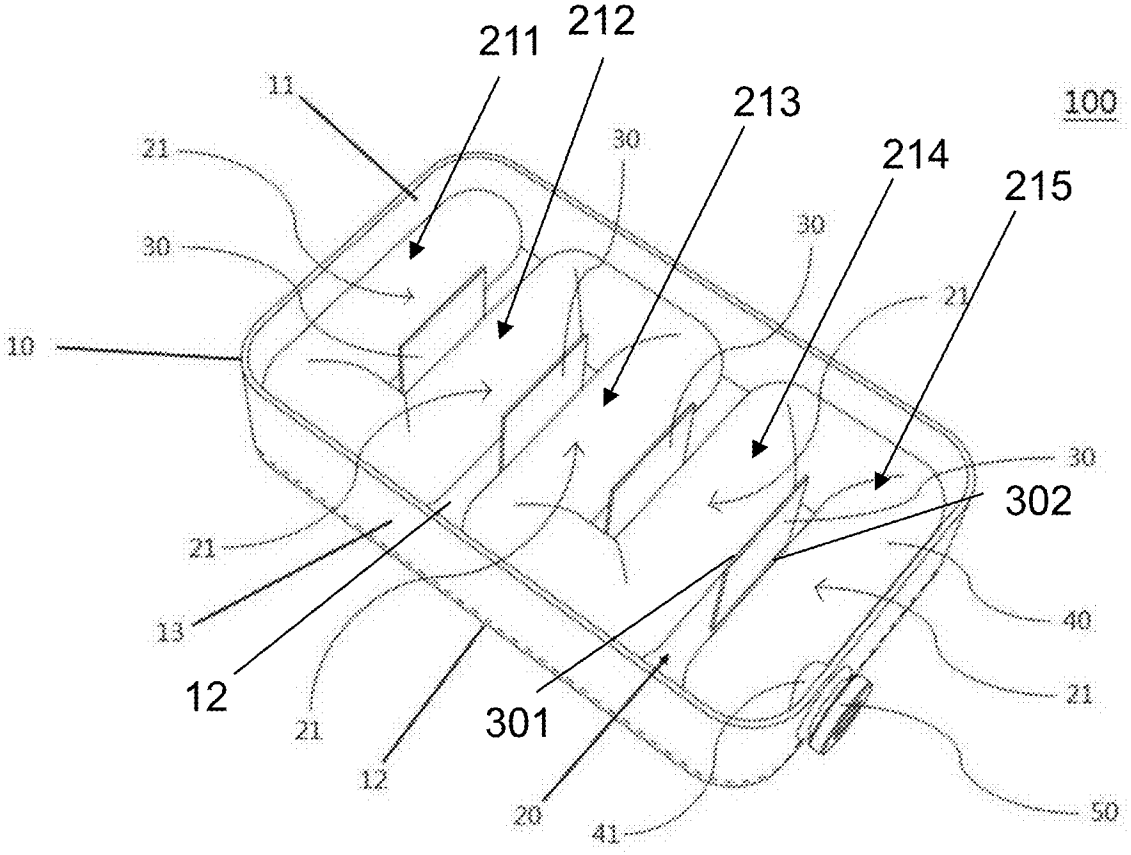
FIG. 1B is a perspective view of the inflatable mattress structure with the detachable air column according to another aspect of the embodiment.
Figure 2:
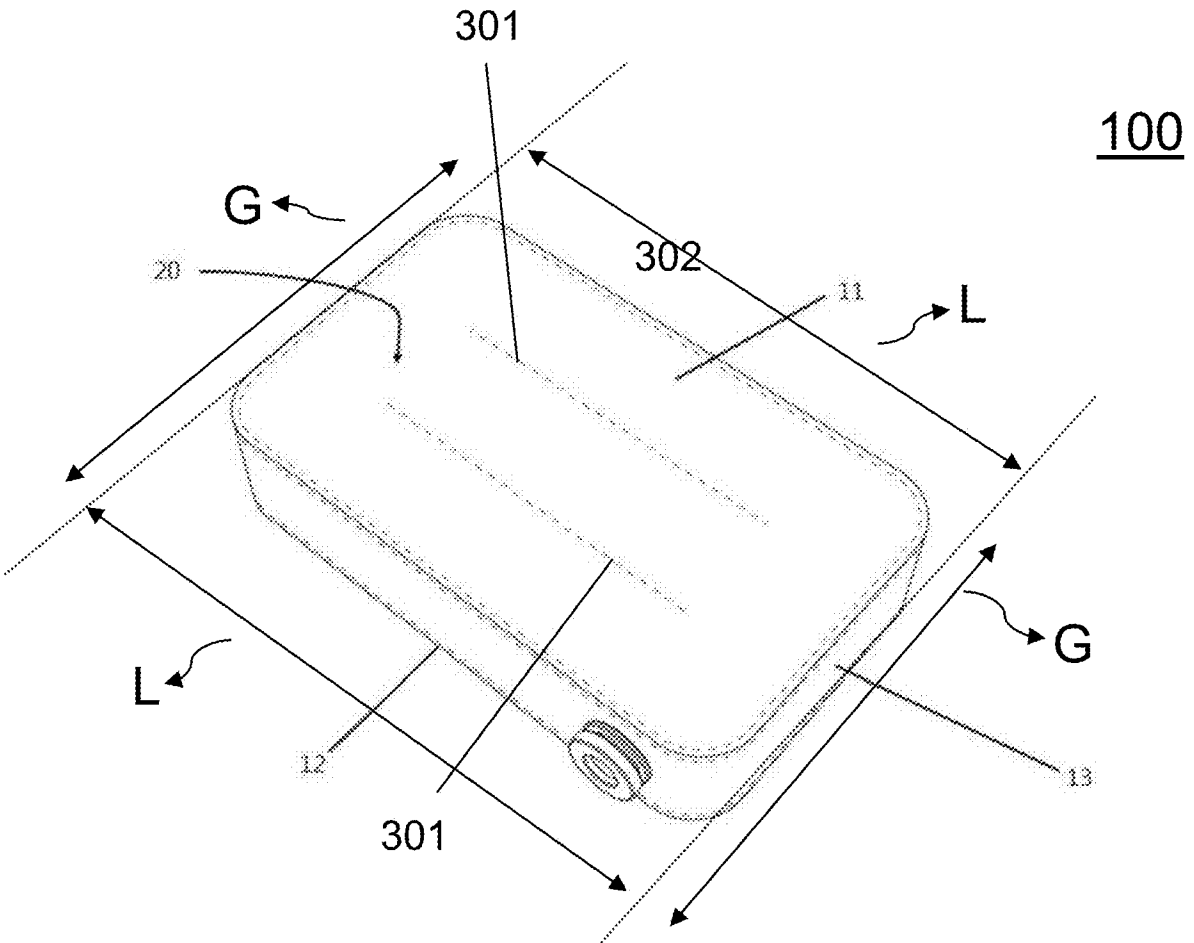
FIG. 2 is another perspective view of the inflatable mattress structure with the detachable air column of FIG. 1 according to an aspect of the embodiment.

FIG. 1A, FIG. 1B, and FIG. 2 generally depict an inflatable mattress structure with a detachable air column according to an embodiment.

Referring to FIG. 1A and FIG. 1B, the inflatable mattress structure with the detachable air columns 100 may be inflated and used on various occasions, such as automotive, household, medical, leisure, and so on. In some embodiments, the inflatable mattress structure 100 may comprise a cover 10, an inner space 20 defined inside the cover 10, at least one main divider 30 arranged inside the inner space 20, at least one air column 40 arranged inside the inner space 20, and an air valve 50 connected and communicated with the air columns 40. As shown in FIG. 1A, FIG. 1B, and FIG. 2 the cover 10 may be made of flexible materials. In some embodiments, the cover 10 may be formed as a three-dimensional airtight container to define the inner space 20. In still some embodiments, the cover 10 may comprise a first top cover portion 11 and a second bottom cover portion 12 oppositely arranged with respect to the first to cover portion 11, wherein the cover 10 may further comprise a middle cover portion 13 integrally extended and formed between the first top cover portion 11 and the second bottom cover portion 12. In some embodiments, the first top cover portion 11 may be parallelly arranged with the second bottom cover portion 12. It should be noted that, in some embodiment, the cover 10 may be defined by the first top cover portion 11, the second bottom cover portion 12, and the middle cover portion 13, wherein the cover 10 may be a rectangular prism, and the inner space 20 may also be a rectangular prism shape defined as a space inside the cover 10. In still some embodiments, the cover 10 may comprise the first top cover portion 11 and a second bottom cover portion 12 arranged opposite to the first top cover portion and integrally extended from the second bottom cover portion 11, wherein the cover 10 may be a one-piece configuration. Referring to FIGS. 1A, 1B, and 2, the inner space 20 may be a hollow space formed inside the cover 10, wherein the material of the cover 10 may have toughness, breathability, or comfortable touch, and in such a way, the cover 10 may not easy to be broken, and the air or water vapor molecules contained in the inner space 20 may be easy to flow and exchange with the outside through the cover 10.

Continuing to FIGS. 1A, 1B, and 2, the first top cover portion 11 may be integrally extended to form the second bottom cover portion 12, wherein the inner space 20 may be formed inside the first top cover portion 11 and the second bottom cover portion 12. It should be noted that, referring to FIG. 1A and FIG. 1B, the first top cover portion 11 is transparent.

Figure 3:
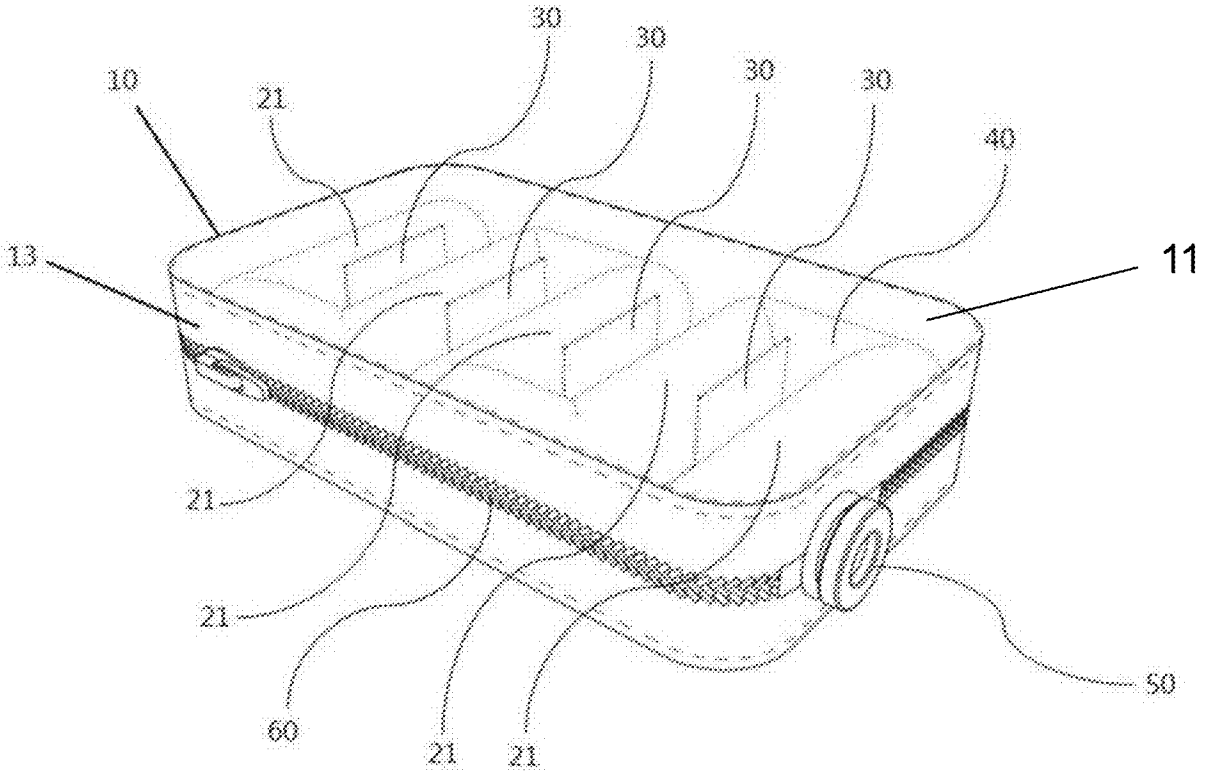
FIG. 3 is a perspective view of the inflatable mattress structure with the detachable air column according to another aspect of the embodiment.

FIG. 3 generally depicts the inflatable mattress structure with the detachable air column 100 according to another embodiment, wherein the first top cover portion 11 is transparent.

In still some embodiments, in order to clean or maintain the inflatable mattress structure with detachable air columns 100 or the inner space 20 of the cover 10, the cover 10 may further comprise a zipper 60 arranged on the middle cover portion 13, wherein the zipper 60 may be a single pull head zipper or a double pull head zipper, and in other words, the zipper 60 may be a one-way zipper or a two-way zipper. In still some embodiments, the middle cover portion 13 may be bisected by the zipper 60. In still another embodiments, the zipper 60 may be arranged between the first top cover portion 11 and the second bottom cover portion 12.

As shown in FIGS. 1A, 1B, 2, and 3, the inflatable mattress structure with detachable air columns 100 may further comprise at least one main divider 30 (including a first main divider 31, a second main divider 32, and . . . ) arranged between the first top cover portion 11 and the second bottom cover portion 12, and in other words, the main divider 30 may be arranged inside the inner space 20. In some embodiments, the main divider 30 may comprise a first divider end 301 connected/coupled to the first top cover portion 11 and a second divider end 302 connected/coupled to the second bottom cover portion 12, wherein the inner space 20 may comprise at least two sub-inner spaces 21, wherein the inner space 20 may be divided by the main dividers 30 to form the sub-inner spaces 21. It should be noted that, in some embodiments, each sub-inner space 21 may be adjacent to each other, and each sub-inner space 21 may be communicated with each other. In some embodiments, the sub-inner spaces 21 may comprise a first inner space 211 formed between the first main divider 31 and the middle cover portion 13, a second inner space 212 formed between the second main divider 32 and the first main divider 31, and a third inner space 213 formed between the second main divider 32 and the middle cover portion 13. In still another embodiment, the sub-inner spaces 21 may comprise the first inner space 211 formed between the first main divider 31 and the cover 10, a second inner space 212 formed between the second main divider 32 and the first main divider 31, and a third inner space 213 formed between the second main divider 32 and the cover 10.

In some embodiments, the first inner space 211 may comprise at least one first opening 2111 communicated between the first inner space 211 and the second inner space 212, wherein the second inner space 212 may comprise at least one second opening 2121 communicated with the third inner space 213 and the second inner space 212.

It should be noted that, in some embodiments, each of the main dividers 30 (including a first main divider 31, a second main divider 32, and . . . ) may be isolated/independent of each other, and in other words, each of the main dividers 30 may not contact with each other. For example, while the inflatable mattress structure with detachable air column 100 comprises only one main divider 30, the inner space 20 may be divided into two sub-inner spaces 21, which may be the first inner space 211 and the second inner space 212. For another example, while the inflatable mattress structure with detachable air columns 100 comprises only two main dividers 30, the inner space 20 may be divided into three sub-inner spaces 21, which may be the first inner space 211, the second inner space 212, and the third inner space 213.

In still some embodiments, each of the main dividers 30 may be parallelly arranged. In still some embodiments, each of the main dividers 30 may be parallel, spaced, and equidistantly arranged with each other, and in this situation, a width "W" may be defined between two of the main dividers 30. As shown in further details in FIG. 1A, the width "W" distance is between the first main divider 31 and the cover 10 (or a right-middle cover portion 131 of the middle cover portion 13). The width "W" distance is between the first main divider 31 and the second main divider 32. The width "W" distance is between the second main divider 31 and the cover 10 (or a left-middle cover portion 132 of the middle cover portion 13), wherein the right-middle cover portion 131 may be arranged on the opposite side of the left-middle cover portion 132. It should be noted that, the cover 10 may further comprise a front-middle cover portion 133 and a rear-middle cover portion 134 arranged on an opposite side of the front-middle cover portion 133, wherein the front-middle cover portion 133 may be integrally extended from the right-middle cover portion 131 and the left-middle cover portion 132, wherein the rear-middle cover portion 133 may be integrally extended from the right-middle cover portion 131 and the left-middle cover portion 132.

Referring to FIGS. 1A, 1B, 2, and 3, the cover 10 may be a rectangular prism, wherein each of the main dividers 30, including the first main divider 31 and the second main divider 32, may be parallelly arranged with the right-middle cover portion 131 and the left-middle cover portion 132. In some embodiments, the length "L" of the left-middle cover portion 132 may be equal to the length "L" of the right-middle cover portion 131, wherein the length "G" of the front-middle cover portion 133 may be equal to the length "L" of the rear-middle cover portion 134.

Figure 4:
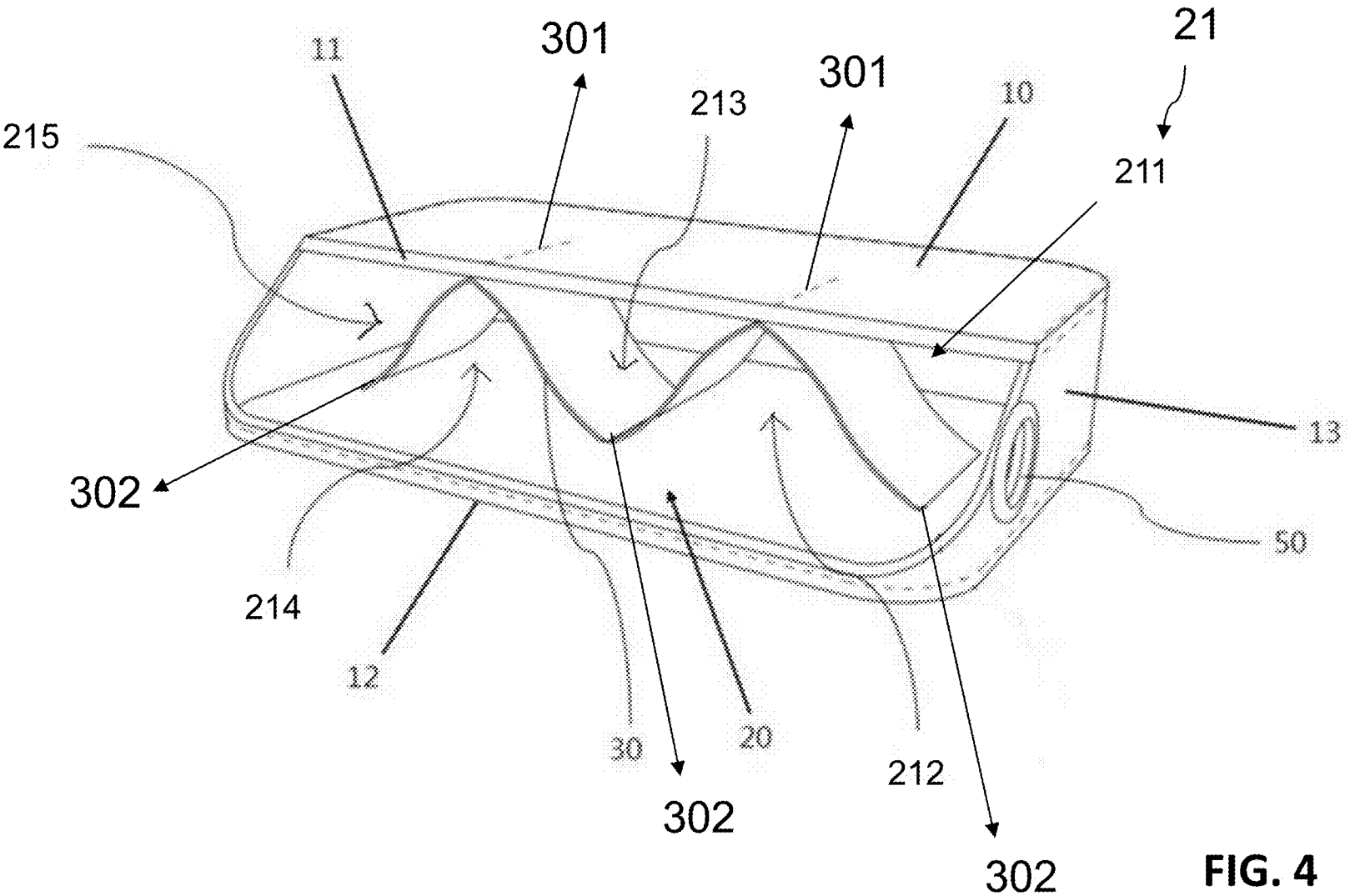
FIG. 4 is a perspective view of the inflatable mattress structure without having the detachable air column according to an aspect of another embodiment.
Figure 5:
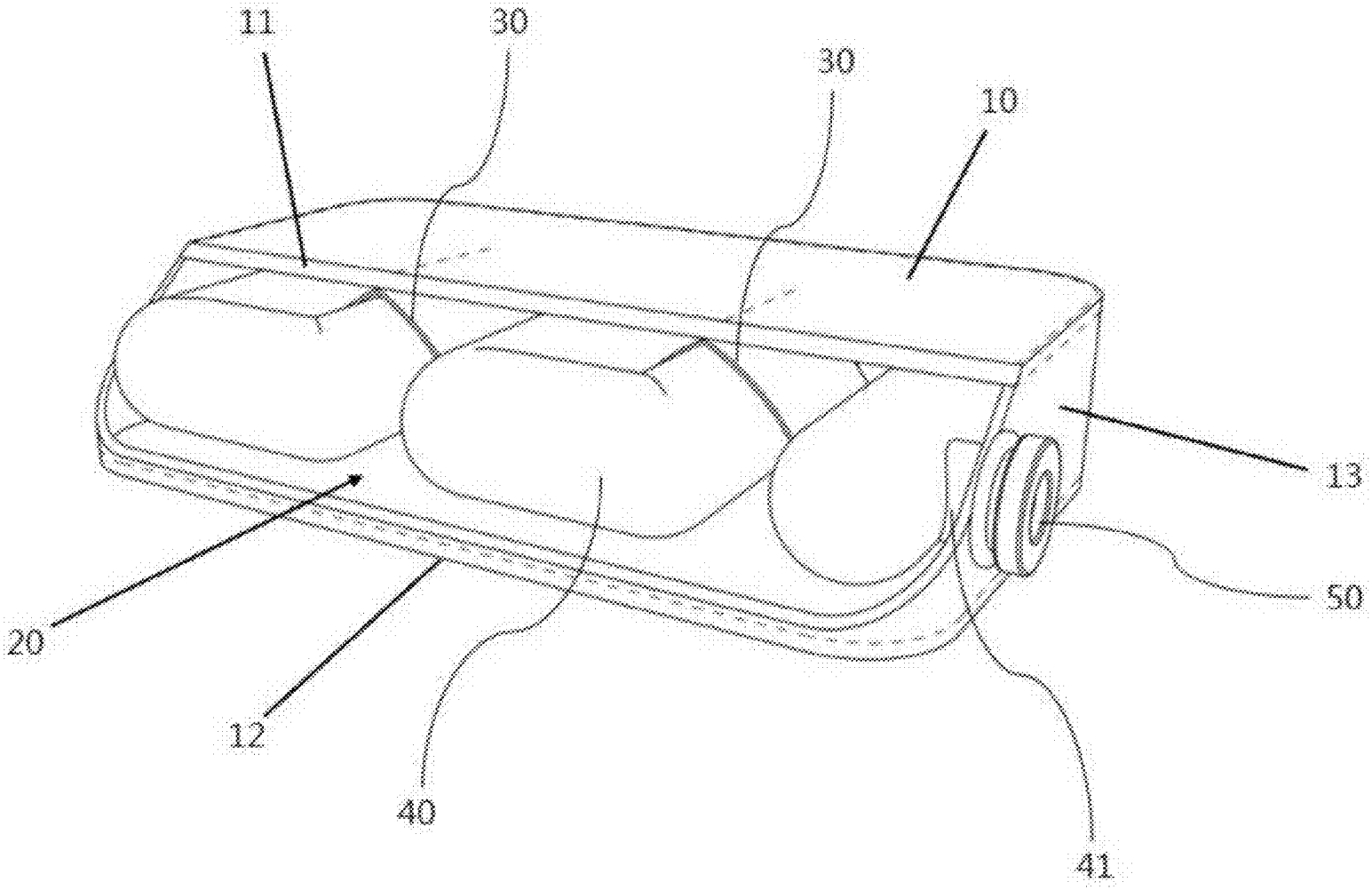
FIG. 5 is a perspective view of the inflatable mattress structure with the detachable air column according to an aspect of another embodiment.

FIGS. 4 and 5 generally depict an inflatable mattress structure with detachable air columns according to another embodiment.

Referring to FIG. 4 and FIG. 5, the main divider 30 may be a zigzag shape, wherein the main divider 30 may be arranged between the first top cover portion 11 and the second bottom cover portion 12, wherein the main divider 30 may comprise at least one first divider end 301 contacted with the first top cover portion 11, wherein the main divider 30 may comprise at least two second divider ends 302 coupled with the second bottom cover portion 12. In some embodiments, the inner space 20 may be divided by the main dividers 30 to form the sub-inner space 21, wherein each sub-inner space 21 may be a triangular shape.

In still some embodiments, the main divider 30 may be connected/coupled with the first top cover portion 11 and the second bottom cover portion 12 by a high-frequency method, a sewing method, or an adhesive method.

According to the above mentioned embodiments, referring back to FIGS. 1A, 1B, 2, 3, and 4, the inflatable mattress structure with detachable air columns 100 may further comprise the air column 40, wherein the air column 40 may be detachably arranged inside the sub-inner space 21, and in such a way, the air column 40 may be passed through each of the sub-inner space 21, in other words, the air column 40 may be passed through each of the sub-inner space 21 in order/one by one. In still some embodiments, the air column 40 may integrally extend from the first inner space 211 to the second inner space 212 and may further integrally extend from the second inner space 212 to the third inner space 213, wherein the second inner space 212 may be arranged between the first inner space 211 and the third inner space 213. In still some embodiments, the air valve 50 may be arranged on the cover 10 (the middle cover portion 13).

Referring to FIG. 4 and FIG. 5, the sub-inner space 21 may further comprise a fourth inner space 214 and a fifth inner space 215 arranged adjacent to the fourth inner space 214, wherein the fourth inner space 214 may be arranged between the fifth inner space 215 and the third inner space 213, and in such a way, the air column 40 may be passed through the first inner space 211, the second inner space 212, the third inner space 213, the fourth inner space 214, and the fifth inner space 215 in order and respectively.

As shown in further details in FIG. 5, the air column 40 may comprise a free end 41 connected/coupled with the air valve 50 for inflating and deflating, wherein while the air column 40 is inflated, the inflatable mattress structure with detachable air columns 100 may be comfortable, breathable, and stable, and at this situation, the inflatable mattress structure with detachable air columns 100 may not easy to be shaking. While the inflatable mattress structure with detachable air column 100 is deflated through the air valve 50, the deflated inflatable mattress structure with detachable air column 100 may be stored easily.

In some embodiments, the air valve 50 may be arranged at the free end 41 of the air column 40 for inflating or deflating the air column, and in such a way, the air column 40 may be inflating or deflating without unzipping the zipper 60. In still some embodiments, the air valve 50 may be passed through the cover 10 and connected/coupled with the free end 41 of the air column 40 for inflating or deflating the air column 40 without unzipping the zipper 60.

In still some embodiments, in order to prevent falling or shaking of the air column 40, the free end 41 of air column 40 may be tightly connected/coupled with the cover 10 and the air valve 50 through buckle, rope strap, or hook and loop fastener. It should be noted that, the body of the air column 40, excluding the free end 41 of the air column, may contact with the cover 10 without securing coupled with the cover to facilitate the detachment of the air column 40, and in such a way, the air column 40 may be passed through the sub-inner spaces 21 during the installation of the inflatable mattress structure.

FIGS. 6A, 6B, 7, and 8 generally depict the inflatable mattress structure with detachable air columns 200 according to an aspect of the embodiment.

Figure 6A:
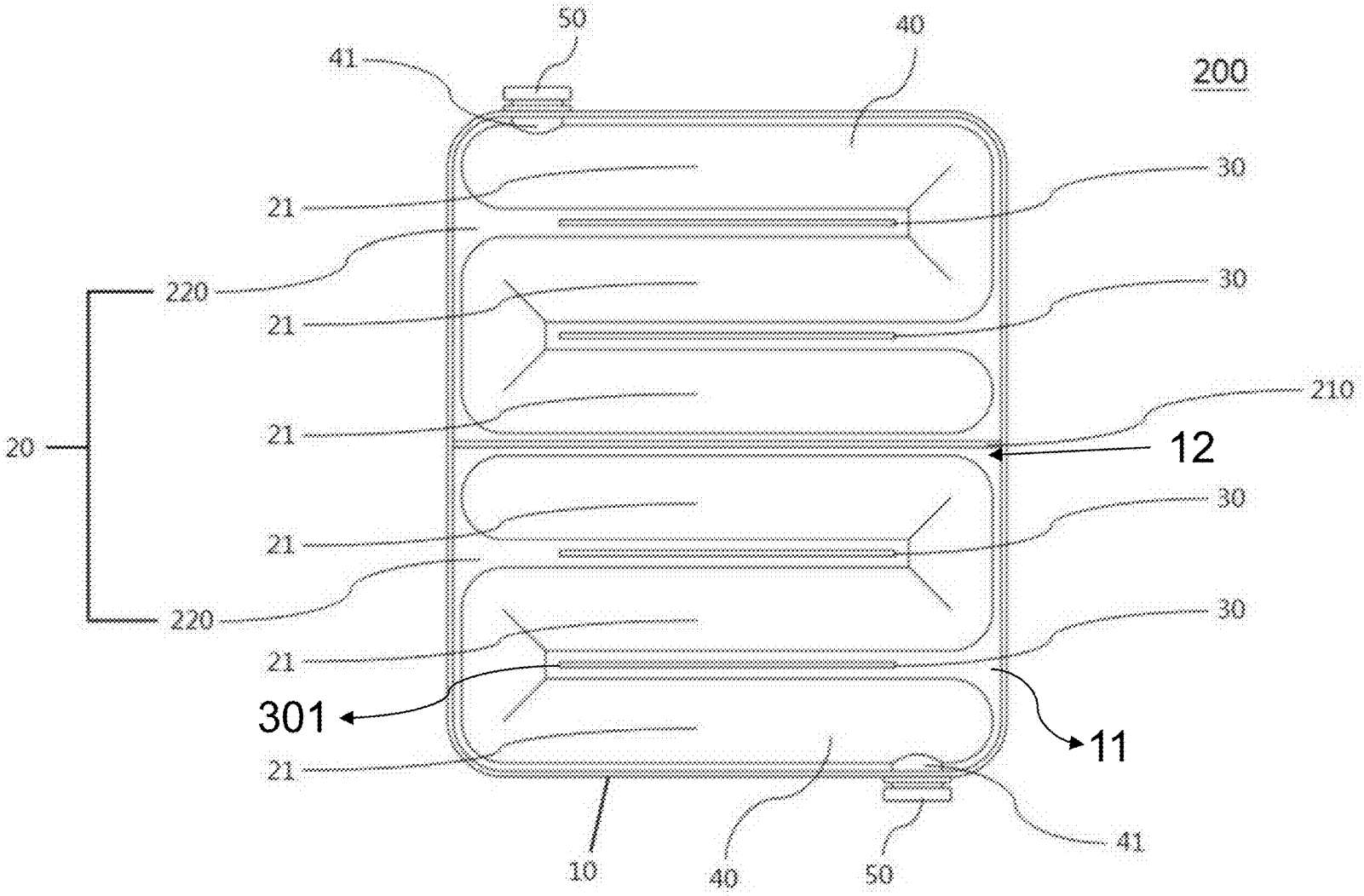
FIG. 6A is a top view of the inflatable mattress structure with the detachable air column according to an aspect of still another embodiment.
Figure 6B:
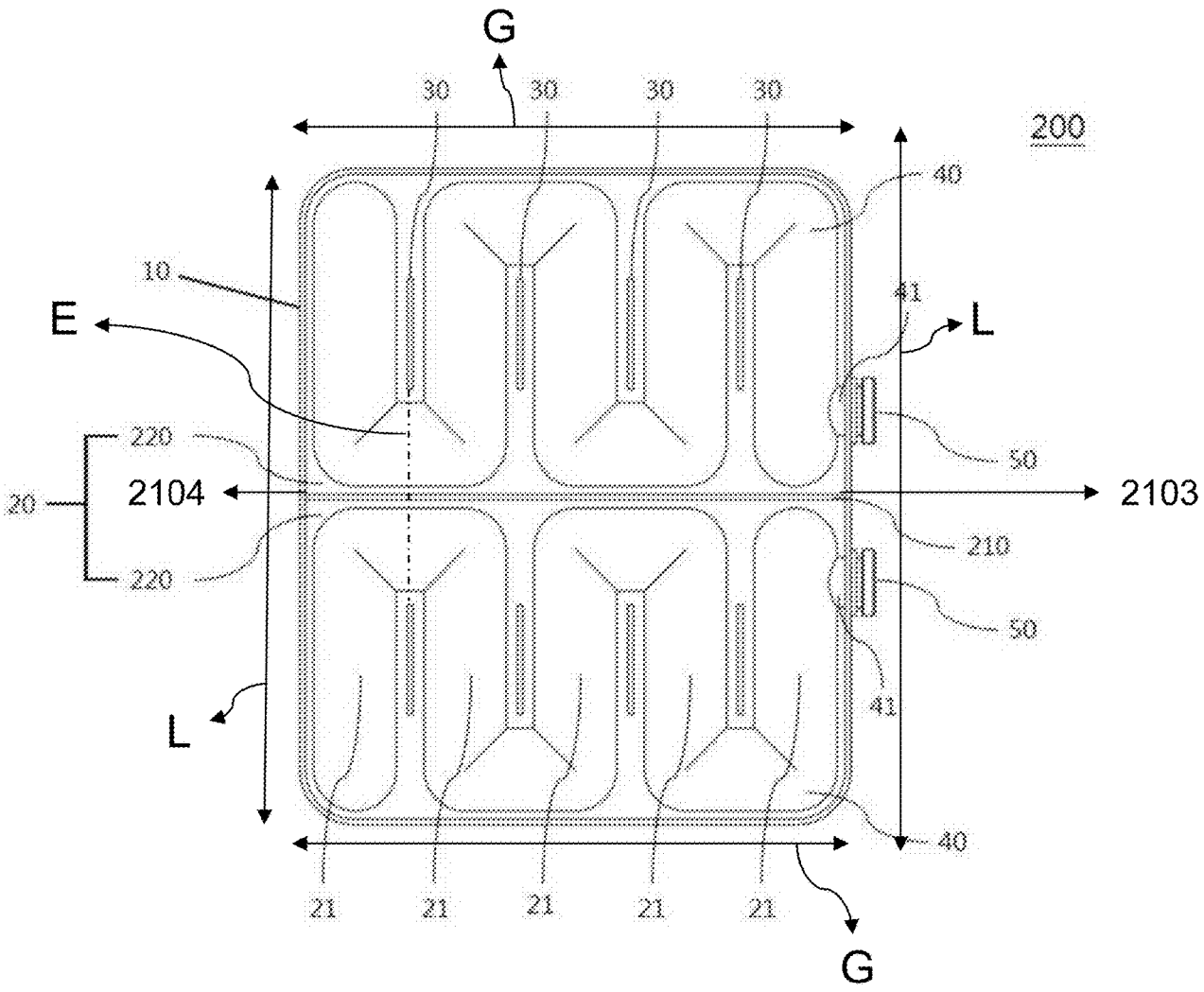
FIG. 6B is a top view of the inflatable mattress structure with the detachable air column according to another aspect of still another embodiment.

Referring to FIG. 6A and FIG. 6B, the inflatable mattress structure with detachable air columns 200 may comprise the cover 10, the inner space 20 defined inside the cover 10, at least one minor divider 210 arranged inside the inner space 20, at least two main dividers 30 arranged inside the inner space 20, and at least two air columns 40.

Figure 7:
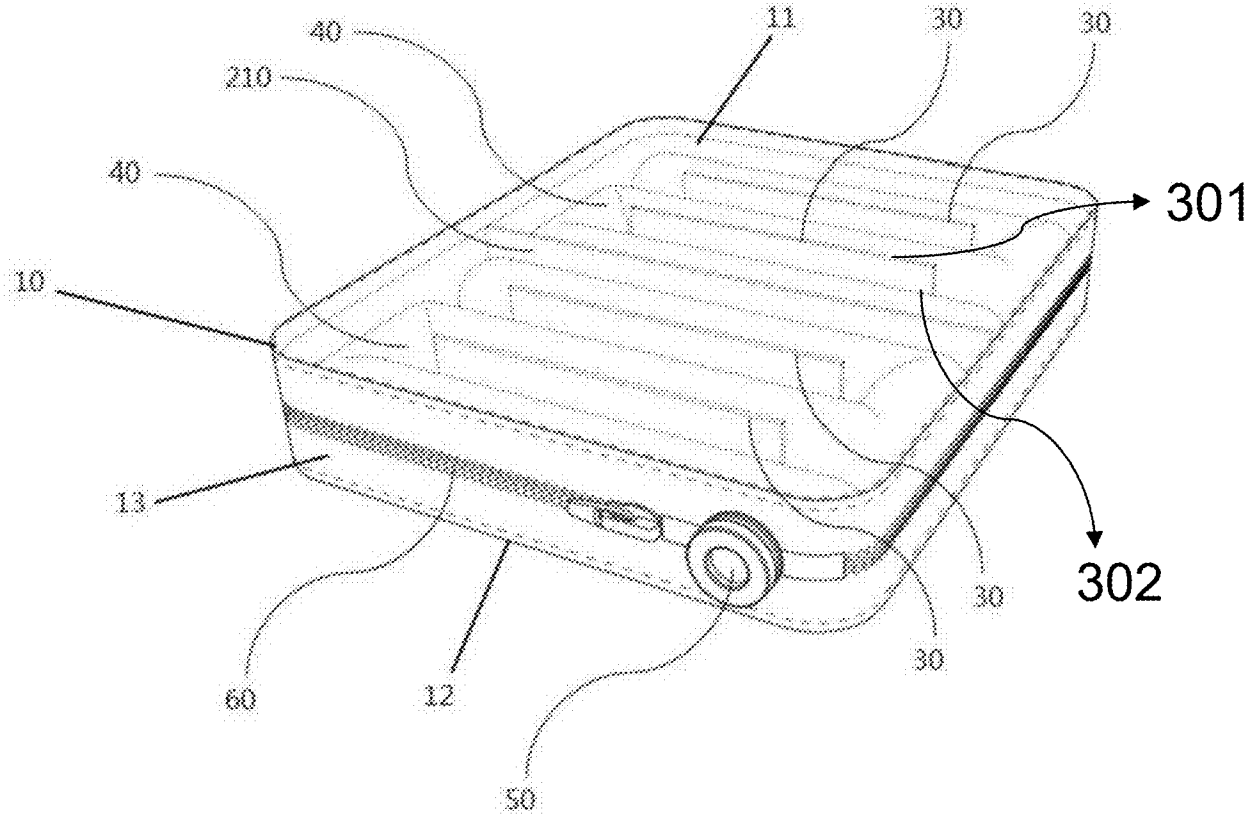
FIG. 7 is a perspective view of the inflatable mattress structure with the detachable air column of FIG. 6A according to an aspect of still another embodiment.
Figure 8:
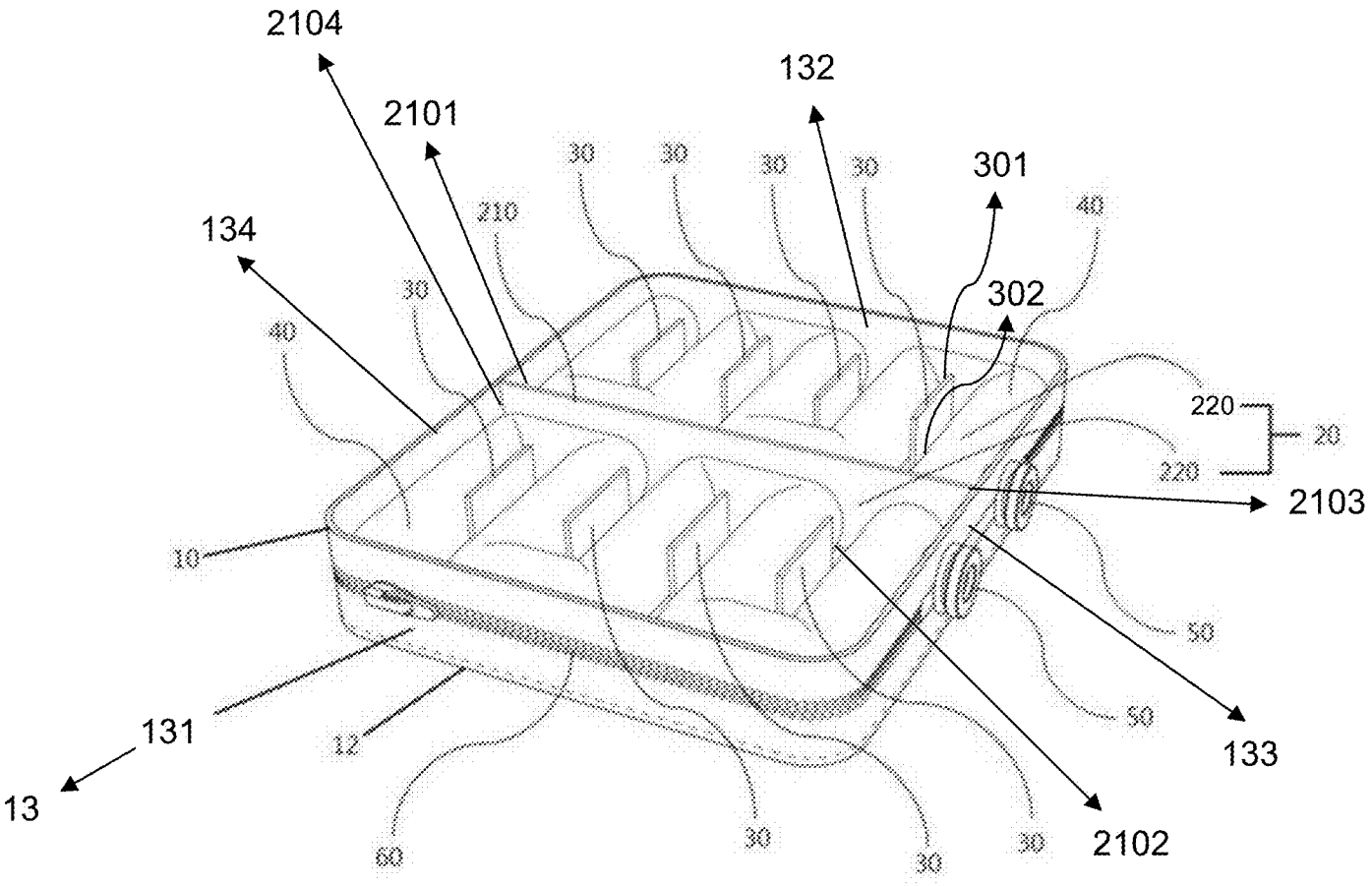
FIG. 8 is a perspective view of the inflatable mattress structure with the detachable air column of FIG. 6B according to another aspect of still another embodiment.
Figure 9:
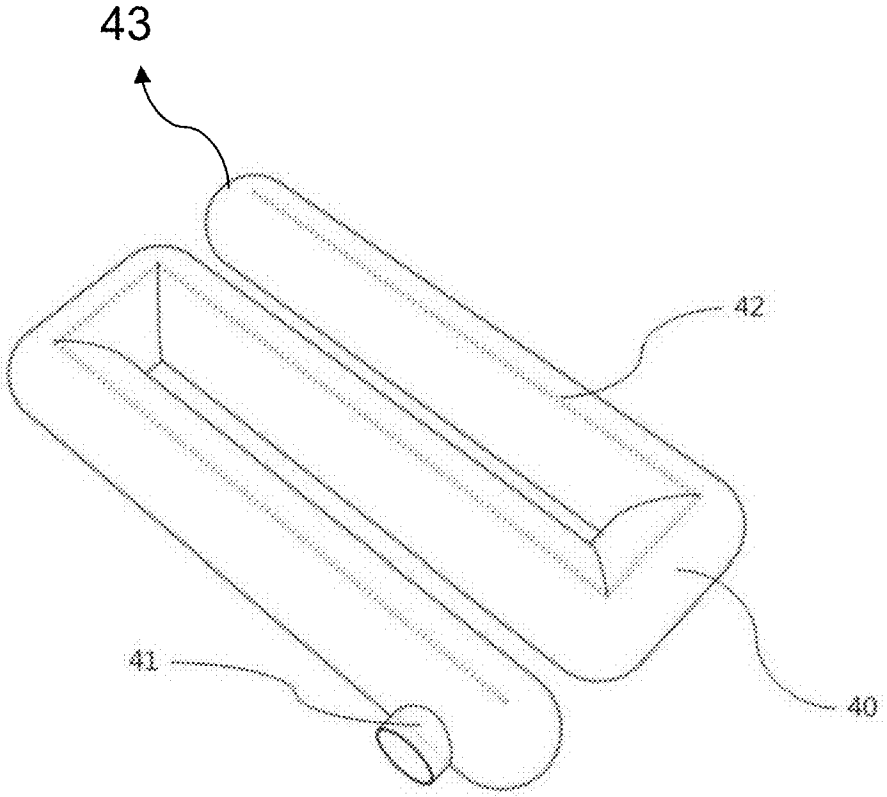
FIG. 9 is a perspective view of the air column according to an aspect of the embodiment.
Figure 10:
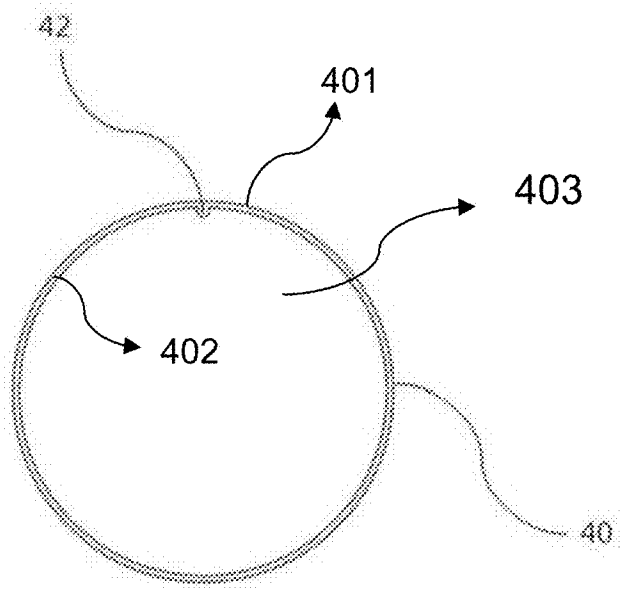
FIG. 10 is a sectional view of the air column according to an aspect of the embodiment.
Figure 11:
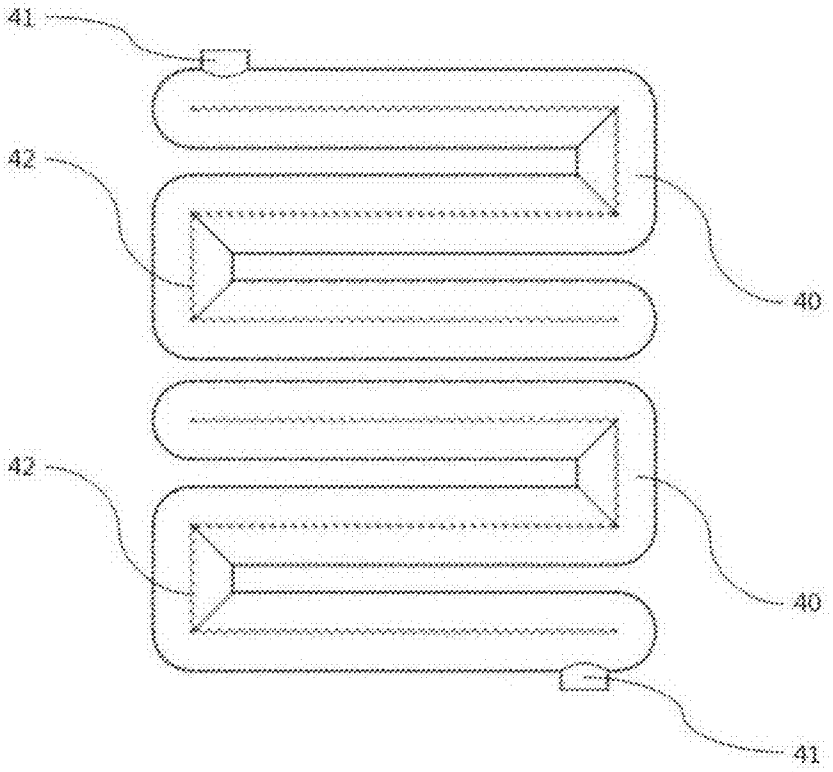
FIG. 11 is a top view of the air column of FIG. 10 according to an aspect of the embodiment.

Continuing to FIG. 7 and FIG. 8, the cover 10 may be identical to the cover 10 as shown in FIG. 1A to FIG. 5, wherein the cover 10 may be made of flexible materials. In some embodiments, the cover 10 may be formed as a three-dimensional airtight container to define the inner space 20. In still some embodiments, the cover 10 may comprise a first top cover portion 11 (which is transparent) and a second bottom cover portion 12 oppositely arranged with respect to the first top cover portion 11, wherein the cover 10 may further comprise a middle cover portion 13 integrally extended and formed between the first top cover portion 11 and the second bottom cover portion 12. In some embodiments, the first top cover portion 11 may be parallelly arranged with the second bottom cover portion 12. In some embodiments, the cover 11 may be defined by the first top cover portion 11 and the second bottom cover portion 12 to form a quadrilateral shape/rectangular prism, wherein the inner space 20 may be also a quadrilateral shape/rectangular prism shape defined as a space inside the cover 10. It should be noted that, in some embodiment, the cover 10 may be defined by the first top cover portion 11, the second bottom cover portion 12, and the middle cover portion 13, wherein the cover 10 may be a quadrilateral shape/rectangular prism, and the inner space 20 may be also a quadrilateral shape/rectangular prism shape defined as a space inside the cover 10.

In some embodiments, the minor divider 210 may comprise a first minor divider end 2101 connected/coupled with the first top cover portion 11, a second minor divider end 2102 connected/coupled with the second bottom cover portion 12, a third minor divider end 2103 connected/coupled with the front-middle cover portion 133, a fourth minor divider end 2104 connected/coupled with the rear-middle cover portion 134. In some embodiments, the inner space 20 may be divided into two identical minor inner spaces 220, and in other words, the inner space 20 may be bisected by the minor divider 210 to form the two identical minor inner spaces 200, wherein each of the two minor inner spaces 220 is an isolated/independent space without communicating with each other.

In some embodiments, the inflatable mattress structure with detachable air columns 200 may comprise two minor dividers 210, wherein the inner space 20 may be divided into three minor inner spaces 220, wherein each of the three minor inner spaces 220 may be isolated/independent from each other without communicating with each other.

Referring to FIGS. 6A, 6B, 7, and 8, in some embodiments, the inflatable mattress structure with detachable air columns 200 may comprise at least one main divider 30 (including a first main divider 31, a second main divider 32, and . . . ) arranged between the first top cover portion 11 and the second bottom cover portion 12, and in other words, the main divider 30 may be arranged inside the inner space 20. In some embodiments, the main divider 30 may comprise a first divider end 301 connected/coupled to the first top cover portion 11 and a second divider end 302 connected/coupled to the second bottom cover portion 12, wherein the minor inner space 220 may comprise a plurality of sub-inner spaces 21, wherein the minor inner space 220 may be divided by the main dividers 30 to form a plurality of sub-inner spaces 21.

It should be noted that, as shown in FIG. 6A and FIG. 7, in some embodiments, each main divider 30 may be parallelly arranged with the minor divider 210.

As shown in FIG. 6B and FIG. 8, in some embodiments, an extension line "E" of each main divider 30 may be perpendicular to the minor divider 210.

As shown in further details of FIG. 6A and FIG. 6B, each minor inner space 220 may comprise one air column 40, wherein the air column 40 may be passed through each sub-inner space 21.

In some embodiments, the air column 40 may comprise the free end 41 connected/coupled with the air valve 50 for inflating and deflating. While the inflatable mattress structure with detachable air column 200 is deflated through the air valve 50, the deflated inflatable mattress structure with detachable air column 200 may be stored easily. It should be noted that, the body of the air column 40, excluding the free end 41 of the air column, may come into contact with the cover 10 without securing coupled with the cover 10 to facilitate the detachment of the air column 40, and in such a way, the air column 40 may be passed through the sub-inner spaces 21 during the installation of the inflatable mattress structure.

In still some embodiments, each of the minor inner spaces 220 may be independent of each other without communicating, and at this situation, it can achieve the excellent independent effect without interfering with each other. In addition, each of the minor inner spaces 220 may comprise its individual air column 40, so while the vibration or shaking happened in one of the minor inner spaces 220, it will not affect the other minor inner spaces 220.

In some embodiments, the cover 10 may further comprise a zipper 60 arranged on the middle cover portion 13 or arranged between the first top cover portion 11 and the second bottom cover portion 12, wherein the zipper 60 may be a single pull head zipper or a double pull head zipper, and in other words, the zipper 60 may be a one-way zipper or a two-way zipper.

According to the above-mentioned inflatable mattress structure with detachable air columns 100 and 200, as shown in FIG. 1A to FIG. 8, the air volume 40 may be inflated to form a tough columnar body or become a closed member that has a flat shape and is easy to bend and fold after being deflated. The cover 10 may be made of breathable, comfortable, and flexible materials.

FIGS. 9-12B generally depicts the air column 40 according to an aspect of the embodiments.

Referring to FIGS. 9-12B, the air column 40 may comprise an elongated protrusion 42 arranged on an inner surface 402 of the air column 40 and an outer surface 401 arranged opposite to the inner surface 402, wherein the outer surface 401 may be exposed to outside. In some embodiments, the elongated protrusion 42 may be integrally and inwardly extended from the inner surface 402, wherein the elongated protrusion 42 may be integrally and concavely extended from the inner surface 402 towards an air column inner space 403 defined to contain the air provided by the air valve 50.

In some embodiments, the elongated protrusion 42 may be utilized to facilitate the processing of inflating or deflating of the air volume 40, and in such a situation, while the air column 40 is deflating, the elongated protrusion 42 may be utilized to prevent the air column 40 from being partially flattened, and at the same time, it could prevent the deflated air column 40 being stuck by the main divider 30.

In still some embodiments, the elongated protrusion 42 may be extended from the free end 41 of the air column 40 to a distal end 43 formed on an opposite end of the free end 41, wherein the size of the elongated protrusion 42 may be selected, wherein the thickness of the elongated protrusion 42 may be 3 mm+−30%.

Figure 12A:
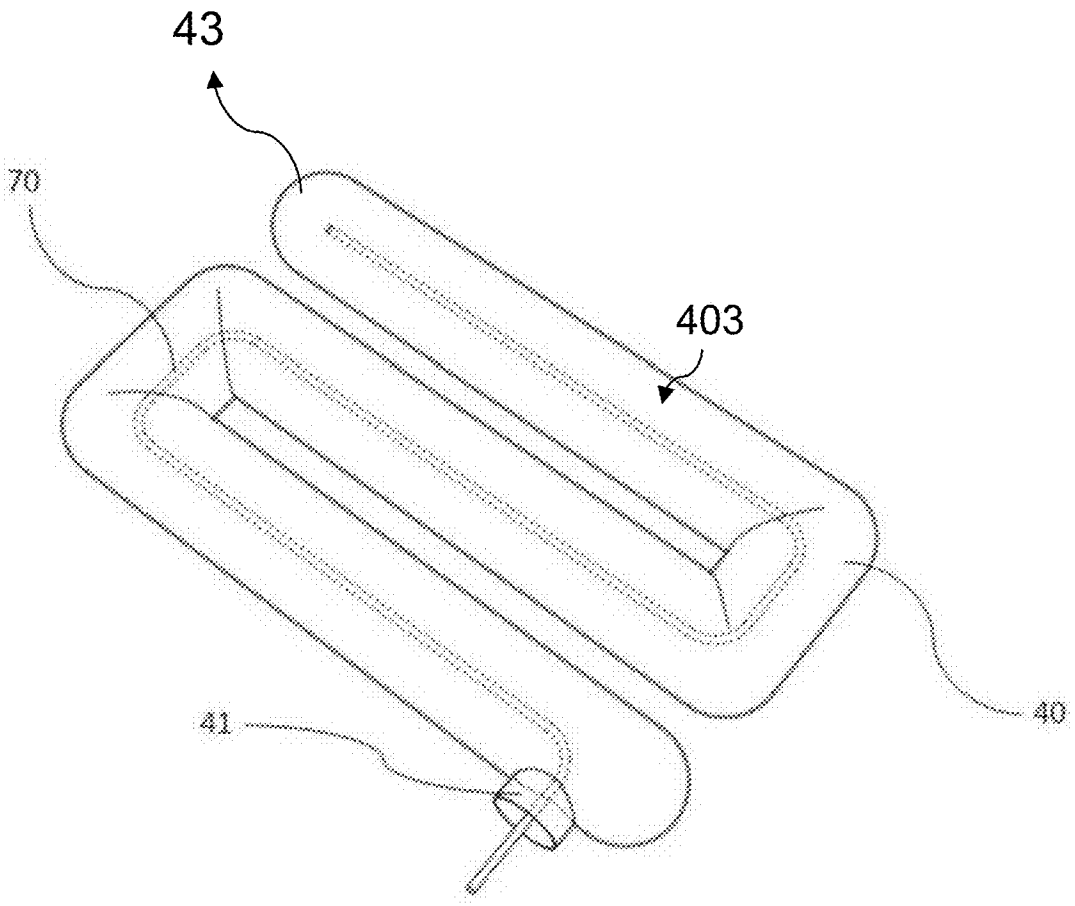
FIG. 12A is a perspective view of the air column according to another aspect of the embodiment.
Figure 12B:
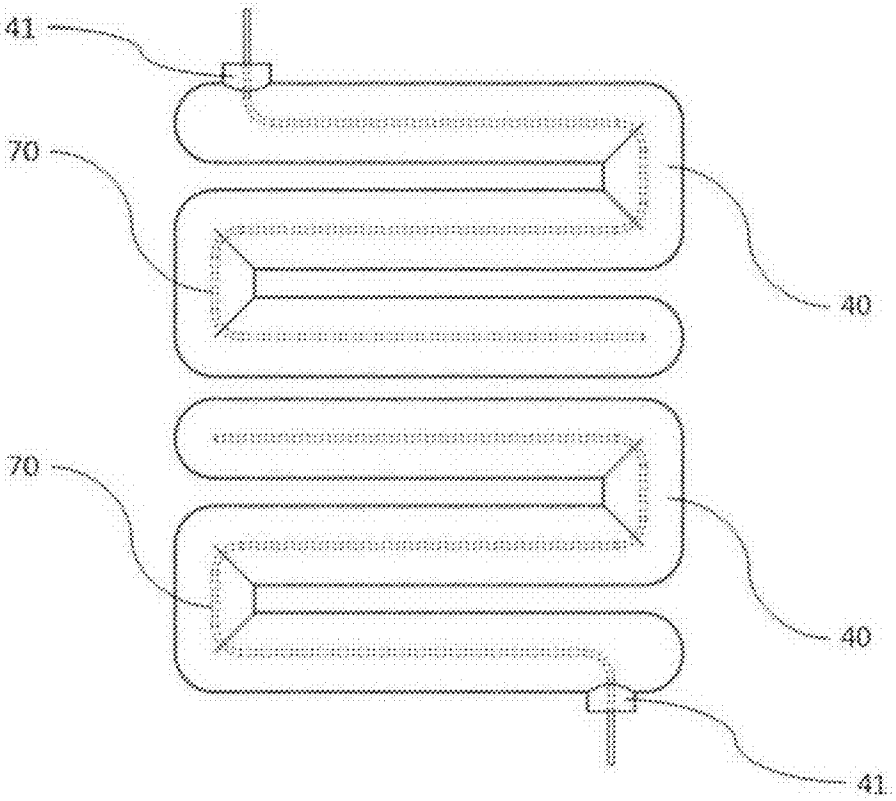
FIG. 12B is a top view of the air column of FIG. 12A according to another aspect of the embodiment.

As shown in further details in FIG. 12A and FIG. 12B, the air column 40 may comprise an elongated supported member 70 arranged inside the air column 40 (arranged inside the air column inner space 403), wherein the elongated supported member 70 may be a three-dimensional strip-shaped member which may be integrally extended from the free end 41 of the air column 40 to the distal end 43 of the air column 40 inside the air column 40, wherein the free end 41 is an opening end and the distal end 43 is a closed-end. As shown in FIG. 12A, the elongated supported member 70 may be passed through the air column 40; in such a way, the free end 41 and the distal end 43 are both opening ends for allowing the elongated supported member 70 to pass through. It should be noted that, the elongated supported member 70 may function as the elongated protrusion 42 to facilitate the processing of inflating or deflating of the air volume 40, and in such a situation, while the air column 40 is deflating, the elongated supported member 70 may be utilized to prevent the air column 40 to be partially flattened, and at the same time, it could prevent the deflated air column 40 being stuck by the main divider 30.

According to the above mentioned the inflatable mattress structure with detachable air columns 100, 200 as shown in FIG. 1A to FIG. 8, the cover 10 and the air columns 40 are two separate items, wherein it is easy to remove, clean, repair, and replace either the cover 10 or the air column 40 during maintenance. Therefore, the inflatable mattress structure with detachable air columns 100 and 200 may be easily reused. In addition, manufacturing the inflatable mattress structure with detachable air columns 100 and 200 is simple and easy. Different sizes and shapes of the manufacturing process of the inflatable mattress structure with detachable air columns 100 and 200 can be manufactured by a single mold. The inner space 20 can be divided into several minor inner spaces 220, and each of the minor inner space 220 may comprise its individual air column 40, and in such a way, each of the minor inner spaces 220 may not easily shake and will not interfere with each other. In addition, the elongated supported member 70 and the elongated protrusion 42 can be utilized to prevent the air column 40 to be partially flattened while the air volume 40 is deflating, and at the same time, it could prevent the deflated air column 40 being stuck by the main divider 30.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, even though the elements of a claim are set forth below in a certain combination, it must be expressly understood that the embodiment includes other combinations of fewer, more, or different elements disclosed herein even when not initially claimed in such combinations.

Thus, specific embodiments and applications of inflatable mattress structures with detachable air columns have been disclosed. It should be apparent, however, to those skilled in the art that many more modifications besides those already described are possible without departing from the disclosed concepts herein. Therefore, the disclosed embodiments are not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be substituted, and what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material, or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in the same way to obtain the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. An inflatable mattress structure, comprising:

a cover made of flexible material and comprising a first top cover portion and a second bottom cover portion arranged opposite to the first top cover portion and integrally extended from the second bottom cover portion;

an inner space defined by the first top cover portion and the second bottom cover portion inside the cover;

at least one main divider comprising a first divider end tightly coupled with the first top cover portion and a second divider end tightly coupled with the second bottom cover portion to divide the inner space into at least two sub-inner spaces; and an air column detachably arranged inside the inner space and passed through each of the sub-inner spaces one by one; and an air valve tightly coupled with a free end of the air column; wherein one of the at least two sub-inner spaces is adjacent to another one of the at least two sub-inner spaces and communicates with the another one of the at least two sub-inner spaces.

2. The inflatable mattress structure of claim 1, wherein the cover further comprises a zipper arranged between the first top cover portion and the second bottom cover portion.

3. The inflatable mattress structure of claim 1, wherein the at least one main divider comprises a plurality of main dividers, wherein each of the main dividers is independent of each other, wherein each of the main dividers does not contact each other.

4. The inflatable mattress structure of claim 1, wherein the at least one main divider is a zigzag shape, wherein the at least one main divider is arranged between the first top cover portion and the second bottom cover portion, wherein the at least one main divider comprises at least one first divider end coupled with the first top cover portion and at least two second divider ends coupled with the second bottom cover portion, wherein each of the sub-inner spaces is a triangular shape.

5. The inflatable mattress structure of claim 1, wherein the air column comprises a free end fixedly coupled with the cover and the air valve and a body contacting with the cover without fixedly coupling with the cover.

6. The inflatable mattress structure of claim 1, wherein the air column comprises an elongated protrusion arranged on an inner surface of the air column and an outer surface arranged on an opposite side of the inner surface and exposed to the outside, wherein the elongated protrusion may be integrally and concavely extended from the inner surface towards an air column inner space defined for containing the air provided by the air valve.

7. The inflatable mattress structure of claim 1, wherein the air column comprises an elongated supported member arranged inside an air column inner space of the air column, wherein the elongated supported member is a three-dimensional strip-shaped member that is integrally extended from the free end of the air column to a distal end of the air column.

8. An inflatable mattress structure, comprising:

a cover made of flexible material and comprising a first top cover portion and a second bottom cover portion arranged opposite to the first top portion:

an inner space defined by the first top cover portion and the second bottom cover portion inside the cover;

at least one minor divider arranged inside the inner space, wherein the inner space is divided to form at least two minor inner spaces by the at least one minor divider, wherein each of the minor inner spaces does not communicate with each other, wherein the at least one minor divider comprises a first minor divider end coupled with the first top cover portion and a second minor divider end coupled with the second bottom cover portion;

at least one main divider comprising a first divider end tightly coupled with the first top cover portion and a second divider end tightly coupled with the second bottom cover portion to divide the inner space into at least two sub-inner spaces; and at least two air columns detachably arranged inside the inner space and passed through each of the at least two sub-inner spaces one by one;

an air valve tightly coupled with a free end of the air column; wherein one of the at least two sub-inner spaces is adjacent to another one of the at least two sub-inner spaces and communicates with the another one of the at least two sub-inner spaces.

9. The inflatable mattress structure of claim 8, wherein the cover further comprises a zipper arranged between the first top cover portion and the second bottom cover portion.

10. The inflatable mattress structure of claim 8, wherein the at least two minor inner spaces are divided by the at least one main divider to form the at least two sub-inner spaces.

11. The inflatable mattress structure of claim 8, wherein at least one air column comprises an elongated protrusion arranged on an inner surface of the air column and an outer surface arranged on an opposite side of the inner surface and exposed to the outside, wherein the elongated protrusion may be integrally and concavely extended from the inner surface towards an air column inner space defined for containing the air provided by the air valve.

12. The inflatable mattress structure of claim 8, wherein at least one air column comprises an elongated supported member arranged inside an air column inner space of the air column, wherein the elongated supported member is a three-dimensional strip-shaped member that is integrally extended from a free end of the air column to a distal end of the air column.

* * * * *